United States Patent [19]

Nishimuro et al.

[11] Patent Number: 4,698,783

[45] Date of Patent: Oct. 6, 1987

[54] ELECTRONIC EQUIPMENT CALENDAR AND RANDOM DAILY MESSAGE GENERATOR

[75] Inventors: Yoshiaki Nishimuro, Hachioji; Osamu Hirata, Tokyo; Kuniomi Kano, Yokohama; Akira Miyakawa, Tokyo; Hideo Fushimoto; Kazumi Sekine, both of Kawasaki, all of Japan

[73] Assignee: Canon Kabushiki Kaisha, Tokyo, Japan

[21] Appl. No.: 894,743

[22] Filed: Aug. 11, 1986

Related U.S. Application Data

[63] Continuation of Ser. No. 674,717, Nov. 26, 1984, abandoned, which is a continuation of Ser. No. 372,553, Apr. 28, 1982, abandoned.

[30] Foreign Application Priority Data

May 18, 1981 [JP] Japan ..... 56-73462

[51] Int. Cl.[4] ..... G04B 47/04; G04G 15/00

[52] U.S. Cl. ..... 364/710; 368/10

[58] Field of Search ..... 364/419, 705, 710, 715, 364/410; 368/10; 40/446, 447, 448, 510; D20/18, 19, 20

[56] References Cited

U.S. PATENT DOCUMENTS

| | | | |
|---|---|---|---|
| 3,999,050 | 12/1976 | Pitroda | 364/419 |
| 4,115,846 | 9/1978 | Laine | 364/900 |
| 4,162,610 | 7/1979 | Levine | 368/10 X |
| 4,312,511 | 1/1982 | Jullien | 364/410 X |
| 4,362,392 | 12/1982 | Kumata | 364/705 X |
| 4,415,271 | 11/1983 | Mori | 368/10 X |

*Primary Examiner*—Jerry Smith
*Assistant Examiner*—Clark A. Jablon
*Attorney, Agent, or Firm*—Fitzpatrick, Cella, Harper & Scinto

[57] ABSTRACT

Electronic equipment comprises a store for storing messages, apparatus for processing time information and generating an output at the beginning of each predetermined time period. The messages and time information may be displayed and one of the messages can be selected at random at the start of each time period and displayed with time information in response to the output of the time information processing means, the same message being prevented from being displayed more than once in a time period that is longer than the first mentioned time period.

10 Claims, 3 Drawing Figures

ELECTRONIC EQUIPMENT CALENDAR AND RANDOM DAILY MESSAGE GENERATOR

This application is a continuation of application Ser. No. 674,717 filed Nov. 26, 1984, now abandoned, which in turn was a continuation of application Ser. No. 372,553 filed Apr. 28, 1982, now abandoned.

BACKGROUND OF THE INVENTION

1. Field of the Invention

The present invention relates to electronic equipment suitable for use in a desk top calculator having a calendar function, and more particularly to electronic equipment that can produce a sentence such as proverb or maxim.

2. Description of the Prior Art

In recent electronic equipment such as desk top calculators, a clocking function such as a clock or a calender function has been added to the inherent calculation function for the convenience of a user. For example, a desk top calculator with a clock which can calculate data in one mode and display the present month, day of month, day of week, hour, minute and second in another mode, and generate an alarm sound at a preset time, has been developed. In a conventional printed calendar, a proverb or a maxim is usually printed on each daily or monthly sheet and many people like such a calendar. Accordingly, the information of the month, day of month, day of week, hour, minute and second presented by currently available electronic equipment having the clocking function is not sufficient, and the development of a desk top calculator having a function also of providing sentences such as proverbs or maxims equal to conventional printed calendars is desirable.

SUMMARY OF THE INVENTION

It is an object of the present invention to provide electronic equipment having a calendar information display function as well as a sentence output function for a proverb or a maxim to present almost as much information as a conventional printed calendar does.

In order to achieve the above object, in accordance with the present invention, a specific address of a sentence information storage means in which proverbs and maxims are stored is specified by a sentence information specifying means in accordance with the processing of a clocking information processing means which processes clocking information such as the day, hour and minute so that appropriate sentence information is put out.

DETAILED DESCRIPTION OF THE PREFERRED EMBODIMENTS

Figure 1:
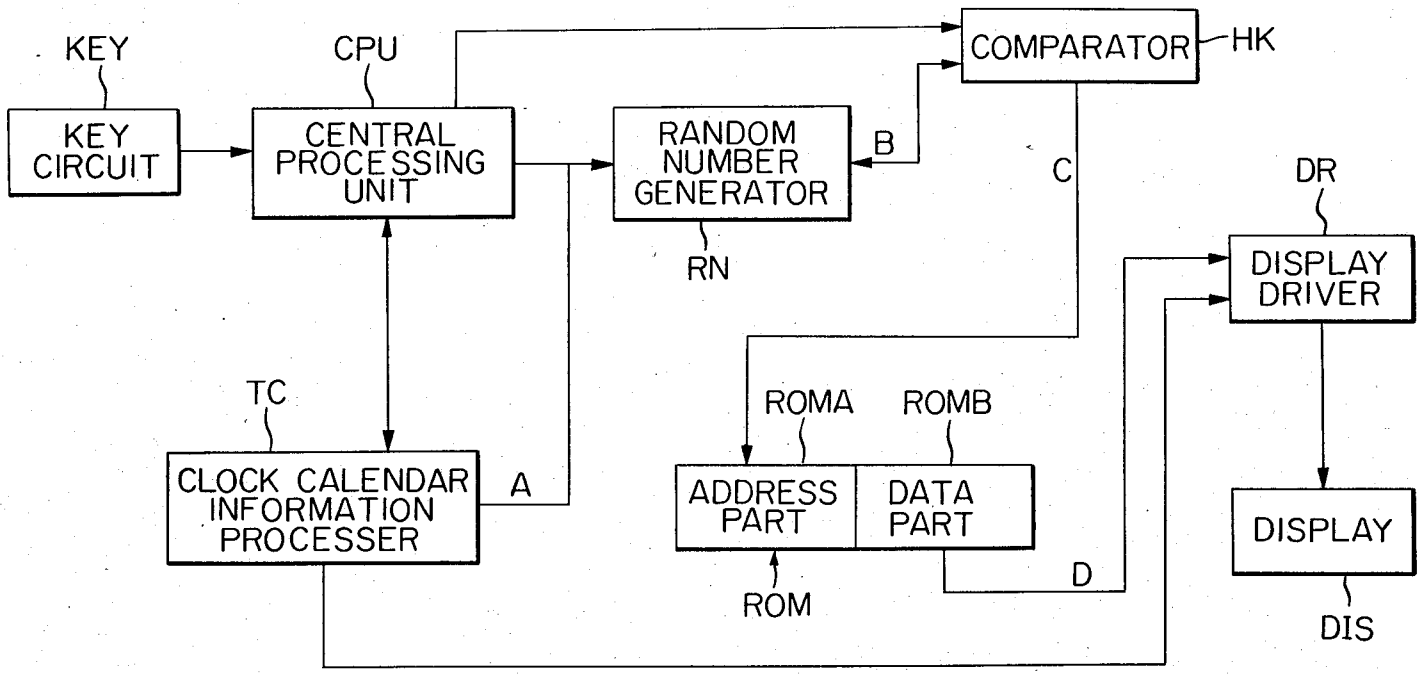
FIG. 1 is a schematic block diagram of one embodiment of electronic equipment in accordance with the present invention.

FIG. 1 is a schematic block diagram of a desk top calculator having a clock in accordance with the present invention. In FIG. 1, KEY denotes a keying circuit which includes ten numeral keys (0–9), function keys (x, ÷, +, − etc.) and time function input keys (hour, minute, month, day etc.) and is used to enter various data.

The data entered by the keying circuit KEY is supplied to a central processing unit CPU which includes an internal ROM (fixed memory), a full adder and registers (not shown) and controls an overall system in accordance with a known ROM system. TC denotes a clock/calendar information processor which comprises a clock circuit including an oscillator for generating a time base signal and a ROM (fixed memory) for storing calendar information, and supplies a signal to a display driver DR in response to an instruction from the CPU to display clock/calendar information on a display unit DIS. RN denotes a random number generator which generates two-digit numbers for specifying an address of an address field ROMA of a fixed memory denoted ROM. The generator RN receives a signal from the clock/calendar information processor TC through a signal line A at a constant interval and generates a random number for each signal and sends the random number to a comparator HK through a signal line B. The comparator HK comprises a RAM (random access memory), not shown, for storing all of the two-digit random numbers previously generated by the random number generator RN and a compare circuit, not shown, for comparing the data read from the RAM with the random number sequentially generated by the random number generator RN in accordance with the process result of the clock/calendar information processor TC. If they are equal, the comparator HK sends a signal through the bilateral signal line B to cause the random number generator RN to generate another random number. If a random number which is not stored in the RAM of the comparator HK is generated, the comparator HK specifies an address of the address field ROMA of the fixed memory ROM through a signal line C so that a corresponding data stored in a data field ROMB is read out and sent to the display driver DR through a signal line D. This corresponding data is converted to a display drive signal to display the data read from the fixed memory ROM on the display unit DIS.

Figure 2:
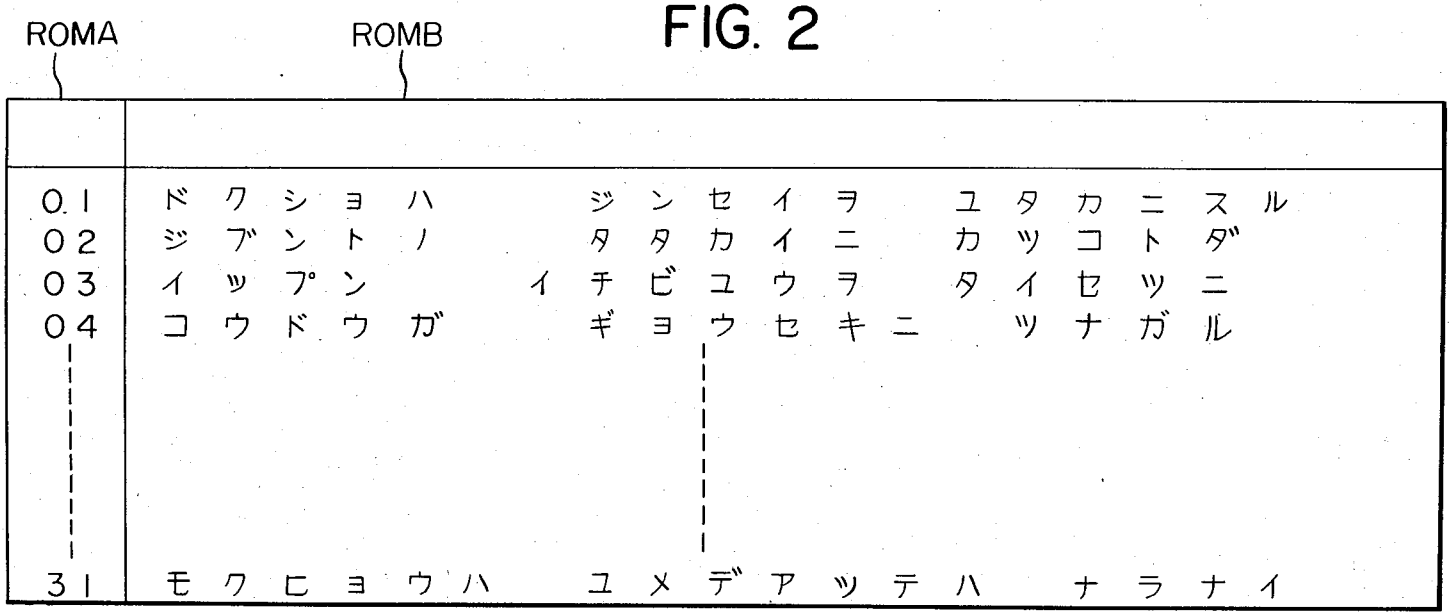
FIG. 2 shows a format of data stored in a fixed memory shown in FIG. 1.

The format of data stored in the fixed memory ROM is explained with reference to FIG. 2. The address field ROMA has 31 addresses 01–31 corresponding to the possible number of days in a month of the calendar, and the corresponding data field ROMB can store information up to 20 digits. While the information is shown in alphabetic characters in FIG. 2 for the convenience of explanation, the data are actually stored as binary coded data.

Figure 3:
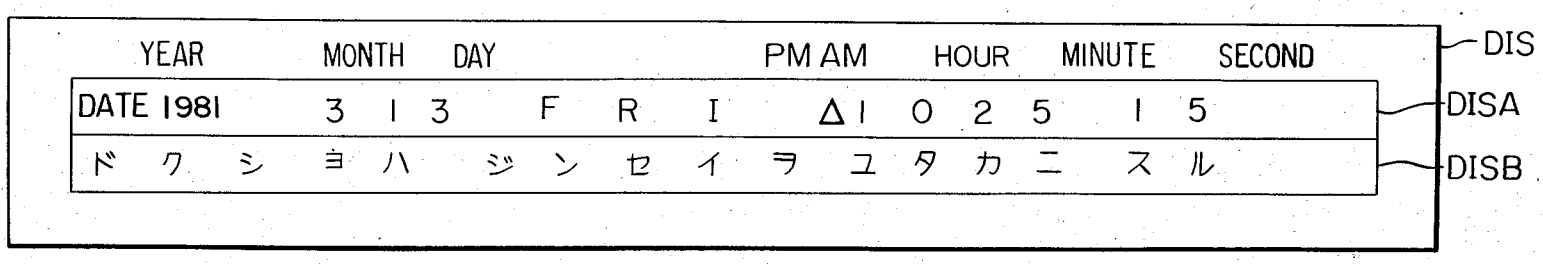
FIG. 3 shows a construction of a display unit such as is shown in FIG. 1.

FIG. 3 shows a construction of the display unit DIS. In the illustrated embodiment, the display unit DIS is a liquid crystal display and has a clock/calendar display field DISA and a sentence information display field DISB for displaying the proverb or the maxim, each having 20 digit positions. For example, numerals, alphabetic characters and a symbol Δ are displayed by 5×7 dot matrices for each digit, and the clock/calendar information is displayed in the DISA and the proverb is displayed in the DISB. When the equipment is used as a desk top calculator, both the clock/calendar display field DISA and the proverb display field DISB are used. The displayed clock/calendar information is identified by the characters representing the year, month, and day printed at the top of the display unit DIS. In the illustrated example, the characters represent 1981 (year), March (month), 13th (day), Friday, AM, 10 o'clock, 25 minutes, 15 seconds, and the proverb display field displays the proverb "reading makes life rich".

The operation of the desk top calculator with the clock in accordance with one embodiment of the present invention is now explained.

The fixed memory ROM which serves as the sentence storage means for storing sentence information such as proverbs stores 31 proverbs in the data field ROMB as described above and one proverb is displayed for each day. The same proverb is not displayed on any other day in the same month. The RAM in the comparator HK shown in FIG. 1 sequentially stores the two-digit random number generated by the clock/calendar information processor TC each time when the date is updated, and the comparator compares the stored random numbers with a newly generated random number to prevent the same proverb from being displayed more than once in the same month. When the month is updated by the clock/calendar information processor TC, the CPU is informed and in turn instructs that all of the two-digit numeric data stored in the RAM be erased on the first day of each month. As a result, the 31 proverbs are again randomly selected. For example, when the date changes from the end of February to March 1st, the CPU detects the change of the month and erases all of the data stored in the RAM of the comparator HK. The random number generator RN generates a two-digit random number and supplies it to the comparator HK. Since no two-digit random number is now stored in the RAM, the data at the same address in the ROMA as the generated random number is read out from the ROMB and displayed. When the date changes from the first day of the month to the second day, the random number generator RN generates a random number and supplies it to the comparator HK. The comparator HK compares the generated random number with the random number for the first day stored in the RAM, and if they are equal it instructs the random number generator RN to generate another random number until a random number different from the random number stored in the RAM is generated. When the different random number is generated, the data at the same address of the ROMA as the random number is read out of the ROMB to display the proverb for the second day. In this manner, a different proverb is displayed every day.

In accordance with the present embodiment, in addition to the conventional clocking information such as month, day, hour, minute, and second, a different proverb is randomly displayed every day in the month independently of the date such as a proverb A on the first day and a proverb B on the second day and so on. Accordingly, the sequence of the proverbs is not fixed but random. This will be convenient for a user.

In the illustrated embodiment, 31 proverbs for one month are stored in the fixed memory ROM and they are selected randomly by the random numbers at every change of the date in the month. Alternatively, when the address 01 of the ROMA is allocated to the first day and the address 02 is allocated to the second day and so on, the sequence of the display of the proverbs is not random but the random number generator RN and the comparator HK can be eliminated and the circuit construction is simplified. Also, instead of storing sentence information such as proverbs in the external ROM, the sentence information may be stored in a software table and the table may be addressed sequentially. In this case, the hardware construction can be simplified. While the sentence information is outputted via the display unit in the illustrated embodiment, the sentence information also may be converted to a voice. This still further enhances the convenience of a user.

As described hereinabove, in accordance with the electronic equipment of the present invention, a specific address of the information storage means which stores the proverbs and the maxims is specified by the sentence information specifying means in accordance with the content of the clock information processing means which processes the clock information such as the day, hour, and minute in order to output appropriate sentence information. Accordingly, the electronic equipment has the calendar information display function as well as a function for putting out sentence information such as proverbs and maxims. Thus, it can present almost as much information as the conventional printed calendar does and enhances the convenience of the user.

What we claim is:

1. Electronic equipment, comprising: means for processing time information and generating an output at the beginning of each occurrence of a first predetermined time period;

storage means for fixedly storing a plurality of messages;

means coupled to said storage means for displaying messages stored in said storage means and for displaying time information;

first control means responsive to the output from said time information processing means for randomly selecting one of the messages stored in said storage means at the beginning of each said first time period and providing the selected one of the messages to said display means for display, the selected message being displayed by said display means in association with displayed time information; and second control means for preventing the same message from being selected more than once by said first control means within a second predetermined time period that is longer than said first time period, wherein said second control means includes means for storing data representative of the messages which have been displayed by said display means, and erases all of the stored data at the beginning of each second time period.

2. Electronic equipment according to claim 1, wherein said time information processing means generates said output with said first time period being one day.

3. Electronic equipment according to claim 1 or 2, wherein said second predetermined time period is one month.

4. An electronic equipment according to claim 1, wherein said messages stored by said storage means are proverbs.

5. Electronic equipment, comprising:

storage means for storing a plurality of messages;

clock means for clocking time for producing time information and for generating an output signal at each occurrence of a first predetermined time period;

selection means for selecting one of the plurality of messages stored in said storage means in response to the output signal generated by said clock means at each occurrence of a first predetermined time period; and display means including a first display region for displaying a message selected by said selection means, and a second display region different from said first display region for displaying time information produced by said clock means, wherein said clock means clocks a second predetermined time period comprising a plurality of the first predetermined time periods and said selection means includes control means for preventing the same message from being selected more than once within the second predetermined time period and wherein said selection means includes means for storing data representative of the messages which have been displayed by said display means, and erases all of the stored data at the beginning of each second time period.

6. Electronic equipment according to claim 5, wherein said first predetermined time period is one day.

7. Electronic equipment according to claim 5, wherein said display means is a dot-matrix display device.

8. Electronic equipment, comprising:

storage means for storing a plurality of messages;

clock means for clocking time for producing time information and for generating an output signal at each occurrence of a first predetermined time period;

selection means for selecting one of the plurality of messages stored in said storage means in response to the output signal generated by said clock means at each occurrence of a first predetermined time period; and display means including a first display region for displaying a message selected by said selection means, and a second display region different from said first display region for displaying time information produced by said clock means, wherein said selection means randomly selects one of the plurality of messages in response to the output signal generated by said clock means and wherein said selection means includes means for storing data representative of the messages which have been displayed by said display means, and erases all of the stored data at the beginning of each second time period.

9. Electronic equipment according to claim 5 or 8 wherein said display means includes means for indicating year, month, day and clock time, said indicating means being displayed near said first display region.

10. Electronic equipment according to claim 5 or 8, wherein said display means is for simultaneously displaying the time information and a selected message.

* * * * *

UNITED STATES PATENT AND TRADEMARK OFFICE

CERTIFICATE OF CORRECTION

PATENT NO. : 4,698,783

DATED : October 6, 1987

INVENTOR(S) : YOHIAKI NISHIMURO, ET AL.

It is certified that error appears in the above-identified patent and that said Letters Patent is hereby corrected as shown below:

COLUMN 1

Line 15, "as proverb" should read --as a proverb--.

COLUMN 4

Line 18, "comprising: means" should read --comprising: ¶ means--.

Signed and Sealed this

Fifth Day of April, 1988

*Attest:*

*Attesting Officer*

DONALD J. QUIGG

*Commissioner of Patents and Trademarks*